US006524071B2

(12) United States Patent
Wong

(10) Patent No.: US 6,524,071 B2
(45) Date of Patent: Feb. 25, 2003

(54) FAN FASTENER RETENTION STRUCTURE

(75) Inventor: Sunny Wong, Kowloon (HK)

(73) Assignee: Litex Industries, Inc., Grand Prairie, TX (US)

( * ) Notice: Subject to any disclaimer, the term of this patent is extended or adjusted under 35 U.S.C. 154(b) by 0 days.

(21) Appl. No.: 09/950,156

(22) Filed: Sep. 10, 2001

(65) Prior Publication Data

US 2002/0048516 A1 Apr. 25, 2002

Related U.S. Application Data

(60) Provisional application No. 60/232,156, filed on Sep. 11, 2000.

(51) Int. Cl.[7] ..... F04D 29/34
(52) U.S. Cl. ..... 416/210 R; 416/244 R
(58) Field of Search ..... 416/5, 210 R, 416/244 R; 403/278, 408.1

(56) References Cited

U.S. PATENT DOCUMENTS 5,951,558 A * 9/1999 Fiz ..... 606/69
6,086,614 A * 7/2000 Mumme ..... 623/18.11
6,210,117 B1 * 4/2001 Bucher et al. ..... 416/210 R
6,352,411 B1 * 3/2002 Bucher et al. ..... 403/302
6,382,917 B1 * 5/2002 Zuege ..... 416/210 R

* cited by examiner

*Primary Examiner*—Ninh H. Nguyen
(74) *Attorney, Agent, or Firm*—Sidley Austin Brown & Wood LLP

(57) ABSTRACT

A structure is provided for retaining one or more fasteners in a corresponding one or more apertures of a first fan element so that, as the first fan element is attached to a second fan element by engaging the fasteners with the second fan element, the fasteners cannot inadvertently fall out of the apertures. The first fan element can thus be attached to the second fan element without the installer having to insert fasteners through apertures in the first fan element while maintaining registration between the first fan element and the second fan element. According to one aspect, the first fan element is a fan blade arm and the second fan element is a fan center hub. According to another aspect, one or more of the fasteners are machine screws.

14 Claims, 2 Drawing Sheets

FAN FASTENER RETENTION STRUCTURE

This application claims priority of U.S. provisional patent application No. 60/232,156, filed Sep. 11, 2000, entitled "Fan Fastener Retention Structure", which is incorporated herein by reference.

TECHNICAL FIELD OF THE INVENTION

This invention relates to a ceiling fan and, in one aspect, to a structure for retaining fasteners in an aperture of a fan element such that the fasteners can be rotated but not removed from the fan element.

BACKGROUND OF THE INVENTION

Ceiling fans are very popular devices for cooling an environment, either indoors or outdoors. The typical ceiling fan has a plurality of fan blades which are attached to fan blade arms secured to a center hub which is rotated. Typically, the fan blade arms are attached to the center hub using a plurality of screws which must be inserted through holes in the fan blade arm and engaged with the center hub. In this arrangement, attachment of the blade arms to the center hub is tedious and time consuming, as the plurality of screws are free to fall out of the holes in the fan blade arm until they are engaged with the center hub. Further, if the fan blade arms are being attached to a fan motor which has already been mounted to a ceiling structure, the fan blade arms must be held in proper registration with respect to the center hub while the plurality of fasteners are inserted through the holes in the fan blade arms and engaged with the center hub. A need exists for an inexpensive, efficient and reliable structure for avoiding the problems and inconvenience associated with the current arrangement now being used.

SUMMARY OF THE INVENTION

The present invention is a structure for retaining one or more fasteners in one or more corresponding apertures in a fan element.

In accordance with one aspect, the present invention has a structure for retaining one or more fasteners in one or more corresponding apertures of a first fan element so that, as the first fan element is attached to a second fan element by engaging the fasteners with the second fan element, the fasteners cannot inadvertently fall out of the apertures. The first fan element can thus be attached to the second fan element without the installer having to insert fasteners through apertures in the first fan element while maintaining registration between the first fan element and the second fan element.

In accordance with another aspect of the present invention, the first fan element is a fan blade arm and the second fan element is a fan center hub.

In accordance with a further aspect of the present invention, one or more of the fasteners are machine screws.

BRIEF DESCRIPTION OF THE DRAWINGS

Advantages and features of the invention will become more apparent with reference to the following description of the presently preferred embodiment thereof in connection with the accompanying drawings, wherein like references have been applied to like elements, in which.

DETAILED DESCRIPTION OF THE INVENTION

Figure 1:
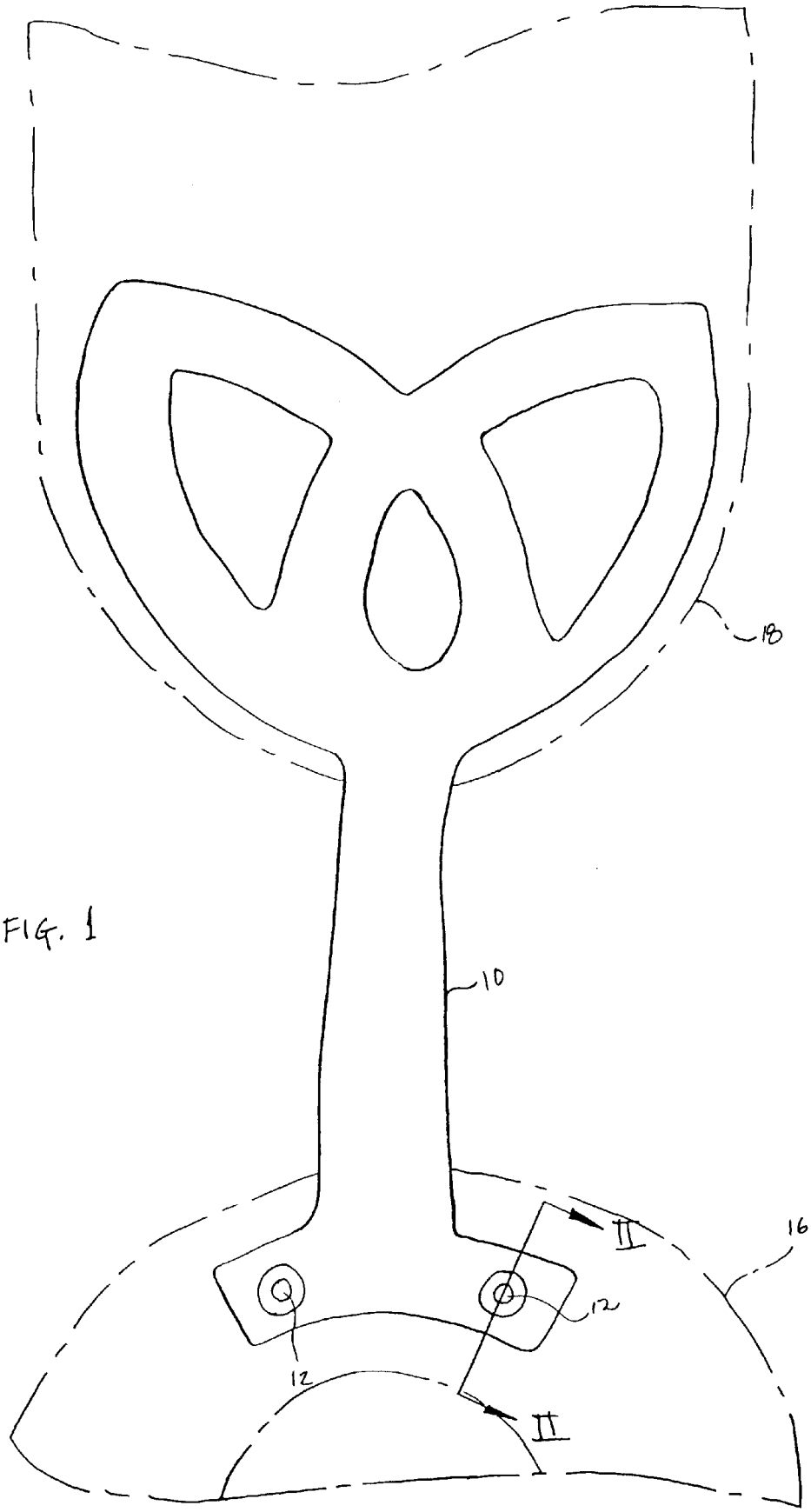
FIG. 1 is a plan view of a fan blade arm assembly of the present invention.

Referring to the figures in general, and to FIG. 1 in particular, a fan blade arm 10 is shown which has a plurality of apertures 12 for receiving a corresponding plurality of fasteners 14 (FIG. 3) for attaching fan blade arm 10 to a center hub 16 (shown in phantom) of the fan. Fasteners 14 can be machine screws or other fastening elements which are appropriate for the application. Fan blade arm 10 is the connecting structure between center hub 16, which rotates as the fan operates, and fan blade 18 (shown in phantom), which moves air when rotated by the fan.

Figure 2:
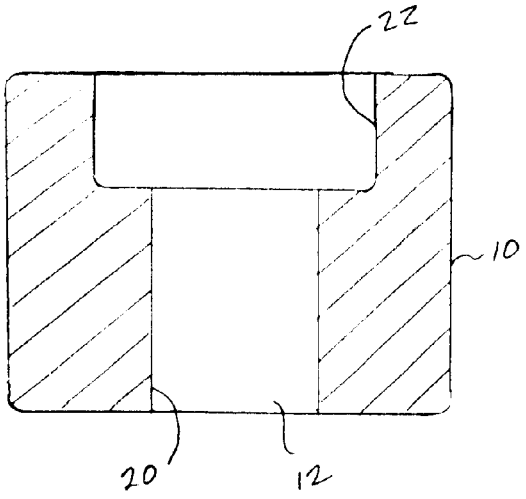
FIG. 2 is a sectional view of the fan blade arm of FIG. 1 taken along the II—II line and showing the configuration of the blade arm before final deformation in accordance with the present invention.
Figure 3:
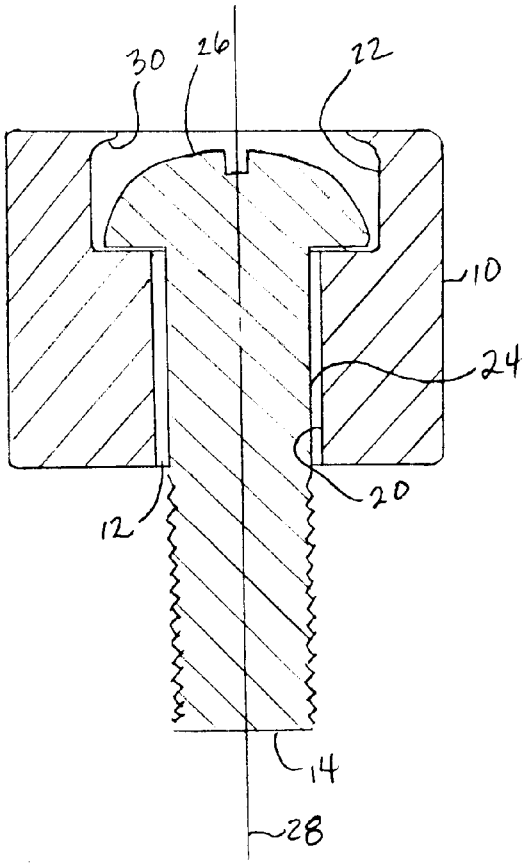
FIG. 3 is a sectional view of the fan blade arm of FIG. 2 after deformation of the blade arm with a fastener disposed in an aperture thereof.

Referring now to FIGS. 2 and 3, an aperture 12 of the present invention is shown which has a first bore 20 and a second bore 22. First bore 20 is adapted to receive a shank portion 24 of fastener 14 and second bore 22 is adapted to receive a head portion 26 of fastener 14. Preferably, each of first bore 20 and second bore 22 are sized so that shank portion 24 and head portion 26 do not interfere with first bore 20 and second bore 22, respectively, so that fastener 14 can be moved along its longitudinal central axis 28 without interference. Aperture 12 further has a retaining structure 30 which reduces the effective diameter of second bore 22, at an end of second bore 22 which is distal to first bore 20, to a size that is smaller than the greatest diameter of head portion 26. Thus, fastener 14 can be moved a limited distance along its longitudinal central axis 28, and fastener 14 is captured within aperture 12.

The present invention is created by first generating one or more apertures 12 in fan blade arm 10. As shown in FIG. 2, the scope of the present invention includes the generation of one or more apertures by any method, but preferably the apertures are generated by drilling and counterboring a fan blade arm at desired locations or by forming the apertures coincident with a casting process which is used to produce the fan blade arm. Referring to FIG. 3, fastener 14 is disposed within aperture 12 such that shank portion 24 is received within first bore 20 and head portion 26 is received within second bore 22. According to one embodiment of the present invention, a portion of second bore 22, which is distal to first bore 20, is deformed to produce a retaining structure 30 so that the effective diameter of second bore 22 is reduced to a size which is smaller than the diameter of head portion 26 of fastener 14, thus capturing fastener 14 within aperture 12.

While the above described embodiment comprises a retaining structure 30 wherein a portion of second bore 22, which is distal to first bore 20, is deformed to produce a retaining structure 30, any structure which retains fastener 14 in aperture 12 is within the scope of the present invention.

Further, while the above described embodiment comprises retaining structure 30 for retaining fasteners 14 which are used to fasten fan blade arm 10 to center hub 16, a structure which retains a fastener in an aperture can be included in any fan element having such an aperture.

Thus, the present invention provides an inexpensive, efficient and reliable structure for retaining fasteners in the apertures of a fan element. The invention eliminates the need for inserting fasteners through apertures in a first fan element while maintaining proper registration between the first fan element and a second fan element and engaging the fasteners with the second fan element. In the present invention, the fasteners are held in place in the first fan element, such as the blade arm, but may be rotated to engage the second fan blade element, such as the fan motor. The present invention prevents the fasteners from falling out of the apertures in the first fan element prior to the fasteners being engaged with the second fan element. As a result, the assembly process is greatly facilitated.

Although the present invention has been described with referenced to a presently preferred embodiment, it will be appreciated by those skilled in the art that various modifications, alternatives, variations, and substitutions of parts and elements may be made without departing from the spirit and scope of the invention. Therefore, the present application is intended to cover such modifications, alterations, variations, and substitutions of parts and elements.

What is claimed is:

1. A fastener structure for a fan comprising:

a fan element having an aperture for a fastener defined in said fan element, said aperture having a first bore and a second bore; and a retaining structure for reducing an effective diameter of a first portion of said first bore, wherein a second portion of said first bore interposes said first portion and said second bore, said second portion having an effective diameter that is greater than said first portion.

2. A fastener structure according to claim 1 wherein said fan element is a fan blade arm.

3. A fastener structure according to claim 1 wherein said retaining structure reduces the effective diameter of said aperture to a size that is smaller than a greatest diameter of said fastener.

4. A fastener structure according to claim 1 wherein said retaining structure reduces an effective diameter of an end of said aperture.

5. A fastener structure according to claim 1 wherein said fan element can be attached to a center hub of said fan by engaging said fastener with said center hub.

6. A fastener assembly for a fan comprising:

a fan element having an aperture therein, said aperture having a first bore and a second bore;

a fastener provided in said aperture, a first portion of said fastener provided in said first bore and a second portion of said fastener provided in said second bore, said second portion having an effective diameter greater than that of said first portion; and a retaining structure for capturing said fastener in said aperture, wherein said retaining structure reduces an effective diameter of said second bore, and wherein said second portion of the fastener is disposed between the retaining structure and said second bore.

7. A fastener assembly as in claim 6 wherein said fan element is a fan blade arm.

8. A fastener assembly according to claim 6 wherein said retaining structure reduces said effective diameter of said second bore at an end of said second bore which is distal to said first bore.

9. A fastener assembly for a fan comprising:

a fan element having an aperture therein, said aperture having a first bore and a second bore;

a fastener provided in said aperture, a portion of said fastener provided in said first bore and a portion of said fastener provided in said second bore; and a retaining structure for capturing said fastener in said aperture, wherein said retaining structure reduces an effective diameter of said second bore, and wherein said first bore is adapted to receive a shank portion of said fastener and said second bore is adapted to receive a head portion of said fastener.

10. A fastener assembly according to claim 9 wherein said retaining structure reduces said effective diameter of said second bore to a size that is smaller than a greatest diameter of said head portion of said fastener.

11. A fastener assembly as in claim 9 wherein said first bore and said second bore are sized so that said shank portion of said fastener does not interfere with said first bore and said head portion of said fastener does not interfere with said second bore.

12. A method of forming a fastener structure comprising:

providing an aperture in a fan element;

positioning a fastener in said aperture; and deforming a portion of said aperture to produce a retaining structure which reduces an effective diameter of said portion of said aperture so that said fastener is captured in said aperture.

13. A method according to claim 12 wherein said step of providing an aperture comprises the sub-step of providing a first bore and a second bore.

14. A method according to claim 12 wherein an end of said second bore is deformed in said step of deforming a portion of said aperture to produce a retaining structure.

* * * * *